US009855782B2

(12) United States Patent
Griffith et al.

(10) Patent No.: US 9,855,782 B2
(45) Date of Patent: Jan. 2, 2018

(54) DE-COLLATABLE BINDINGS AND METHODS OF PRODUCING THE SAME

(71) Applicant: R.R. Donnelley & Sons Company, Chicago, IL (US)

(72) Inventors: Joel Wayne Griffith, Effingham, IL (US); Patrick Steven Lawson, Ashmore, IL (US); Paul Christopher Smith, Champaign, IL (US)

(73) Assignee: LSC COMMUNICATIONS US, LLC, Chicago, IL (US)

( * ) Notice: Subject to any disclaimer, the term of this patent is extended or adjusted under 35 U.S.C. 154(b) by 53 days.

(21) Appl. No.: 15/000,778

(22) Filed: Jan. 19, 2016

(65) Prior Publication Data

US 2017/0203599 A1 Jul. 20, 2017

(51) Int. Cl.

| | |
|---|---|
| ***B42D 1/00*** | (2006.01) |
| ***B42D 1/04*** | (2006.01) |
| ***B42D 5/00*** | (2006.01) |
| ***B42D 1/10*** | (2006.01) |
| ***B42C 9/00*** | (2006.01) |

(52) U.S. Cl.

CPC ..... *B42D 5/00* (2013.01); *B42C 9/0006* (2013.01); *B42D 1/00* (2013.01); *B42D 1/001* (2013.01); *B42D 1/04* (2013.01); *B42D 1/10* (2013.01)

(58) Field of Classification Search

CPC ..... B42D 1/001; B42D 1/00; B42D 1/04
USPC ..... 281/16, 17, 45
See application file for complete search history.

(56) References Cited

U.S. PATENT DOCUMENTS

| | | | | |
|---|---|---|---|---|
| 4,440,422 | A | 4/1984 | Bruchas | |
| 4,768,766 | A | 9/1988 | Berger et al. | |
| 4,789,147 | A | 12/1988 | Berger et al. | |
| 5,054,984 | A | 10/1991 | Chan et al. | |
| 5,112,179 | A | 5/1992 | Chan et al. | |
| 7,744,128 | B2 * | 6/2010 | El-Sorrogy | B42D 1/002 281/16 |
| 8,820,792 | B2 | 9/2014 | Lee et al. | |
| 2006/0022448 | A1 * | 2/2006 | Bolton | B42D 1/001 281/16 |
| 2008/0111367 | A1 * | 5/2008 | McCabe | B42D 1/001 281/21.1 |
| 2008/0303263 | A1 * | 12/2008 | Blau | B42D 1/00 281/16 |
| 2009/0318052 | A1 | 12/2009 | Prescott | |
| 2011/0175342 | A1 | 7/2011 | Lee et al. | |

(Continued)

FOREIGN PATENT DOCUMENTS

| | | | | |
|---|---|---|---|---|
| DE | 637623 C | * | 10/1936 | B42D 1/04 |
| FR | 1349214 A | * | 1/1964 | B42D 1/04 |

(Continued)

OTHER PUBLICATIONS

FR 2796003 Translation.*

*Primary Examiner* — Kyle Grabowski
(74) *Attorney, Agent, or Firm* — Hanley, Flight & Zimmerman, LLC

(57) ABSTRACT

De-collatable bindings and methods of producing the same are disclosed. A disclosed includes a cover defining a spine and signatures disposed within the cover. The disclosed also includes a low tack adhesive disposed between the spine of the cover and the signatures to facilitate removal of the signatures from the cover.

19 Claims, 10 Drawing Sheets

(56) References Cited

U.S. PATENT DOCUMENTS

2012/0112448 A1* 5/2012 Lo ..... B42D 1/001
281/16

FOREIGN PATENT DOCUMENTS

FR 2572680 A1 * 5/1986 ..... B42D 1/001
FR 2796003 A1 * 1/2001 ..... B42D 1/001

* cited by examiner

DE-COLLATABLE BINDINGS AND METHODS OF PRODUCING THE SAME

FIELD OF THE DISCLOSURE

This disclosure relates generally to book bindings, and, more particularly, to de-collatable bindings and methods of producing the same.

BACKGROUND

Books with de-collatable/separable signatures (e.g., flyers and/or catalogs) that are separated from a cover are used for distribution of the signatures. Typically such books utilize stitches (e.g., staples) to couple each of the removable signatures to respective bindings (e.g., spines) of a cover for retaining the signatures prior to their distribution. However, the removal of these signatures can be difficult and/or cumbersome due to the stitches, which may maintain a high retention force and/or cause tearing of the signatures or cover of the book as the signatures are pulled away from the bindings. Use of these stitches also requires added cost, equipment and/or significant manufacturing line time.

As an alternative to stapling de-collatable signatures to bindings, in some known examples, signatures may be printed, collated and placed in separate bags for distribution. However, placing these signatures into separate bags also requires special equipment and added costs. Further, the signatures can be cumbersome to remove from their respective bag (e.g., the bag may require tearing and/or significant manipulation, etc.) during distribution of the signatures (e.g., in a classroom).

Figure 1:
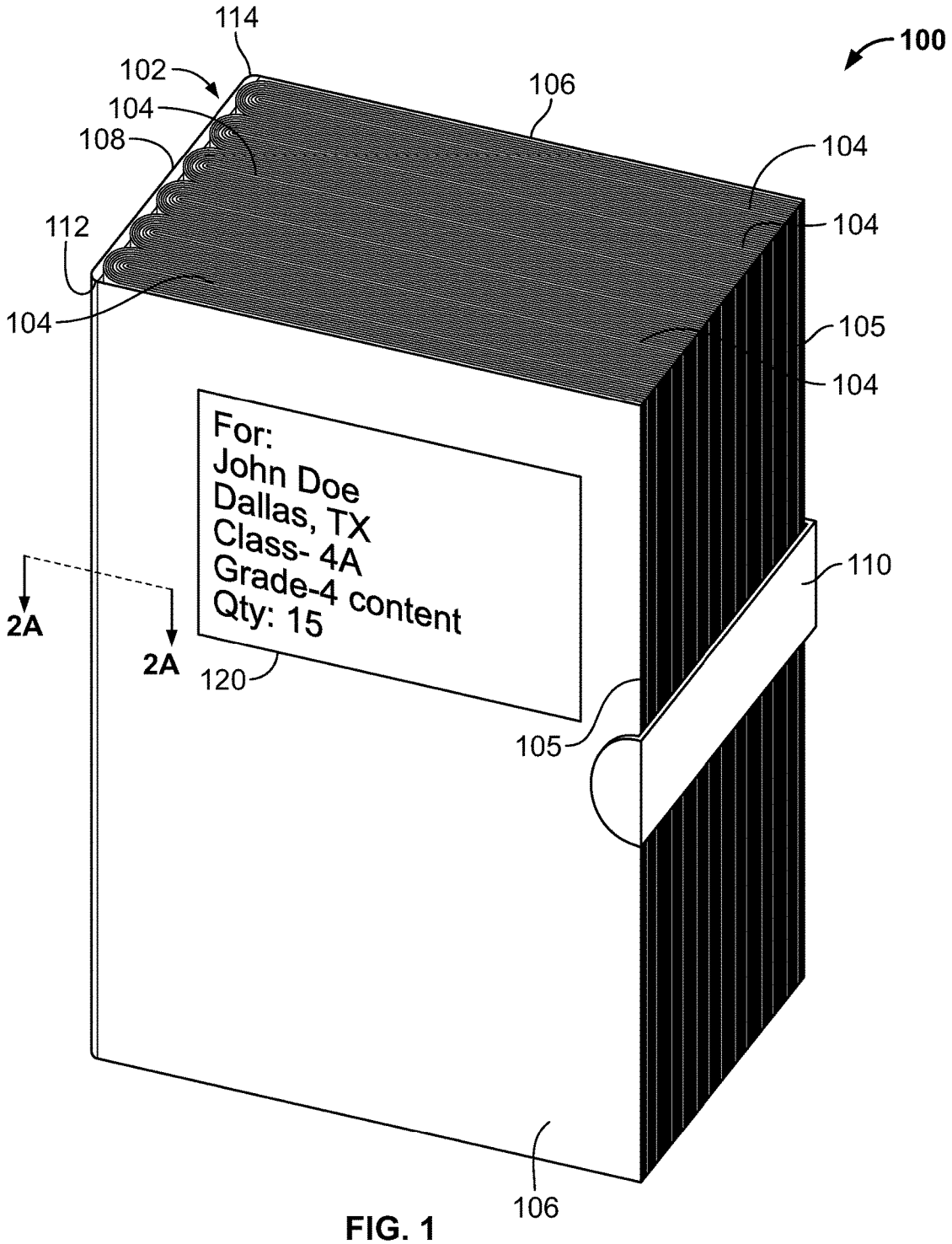
FIG. 1 illustrates an example book produced in accordance with the teachings of this disclosure.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

De-collatable bindings and methods of producing the same are disclosed. The examples disclosed herein relate to de-collatable books in which a low tack adhesive is used to bind signatures of the books to a cover so that the signatures are easily separable from the cover during distribution of the signatures. In contrast to the examples disclosed herein, traditional de-collatable (e.g. separable for distribution) books utilize staples to retain the signatures to the books until the signatures are de-collated, which can cause these books to be difficult to de-collate. Other known traditional examples include separating multiple signatures into plastic bags (e.g., transparent and/or sealed bags for distribution). In such examples, placing multiple signatures in the bags may involve special equipment, capital and/or labor costs, etc. Further, some other known traditional binding processes may require sawing or cutting folded edges of the signatures prior to adhering signatures to a cover. Some traditional processes include preparing spines with appropriate roughing, notching and/or slitting patterns to more effectively bind the signatures to a cover via an adhesive. In contrast, the example books disclosed herein allow ease of separation of signatures from an outer binding (e.g., a cover) while the adhesive remains with the outer binding after removing one or more of the signatures from the outer binding. Further, the examples disclosed do not necessitate use of sawing or cutting processes, nor do they require roughing, notching and/or slitting patterns, which are often associated with known traditional binding processes, thereby saving manufacturing costs and time associated with such processes.

To produce the example de-collatable books in accordance with the teachings of this disclosure, signatures are stacked, aligned relative to one another and provided with an adhesive (e.g., a low tack adhesive) along a portion of their respective spines. For example, each stack of multiple signatures is dispensed with this adhesive as the entire stack moves along a conveyor, for example. In some examples, a portion of a length of the spines of the signatures is dispensed with adhesive. After the signatures are provided with the adhesive, an outer binding/cover is aligned and assembled to the signatures to couple the signatures to the cover via the dispensed adhesive. In particular, the dispensed adhesive couples an inner surface of the spine of the binding/cover to spines of the signatures as the cover is assembled to the signatures.

In other examples, the signatures are placed into the outer binding/cover to couple the signatures to the cover. Regardless of whether the signatures or the cover are assembled to the other, the signatures of the examples disclosed herein can be easily removed for distribution without undue effort that can result from staples and/or other known binding processes.

As set forth in the examples disclosed herein, to cause an adhesive dispenser to dispense adhesive (e.g., a low tack adhesive) to portion(s) of signatures along respective spines (e.g., center folds, fold lines, binding folds, etc.) of the signatures and/or an internal surface of a spine of an outer cover/binding, in some examples, a controller uses positional data from a sensor, a rate of travel and/or a distance of travel of the conveyor from an encoder (e.g., a pulse encoder). The controller may periodically or continually receive information from the sensor/encoder to vary contact and/or a distance of a blade relative to an adhesive roller to control an amount of adhesive applied to each stack of signatures and/or a portion of the stack of signatures that is to receive the adhesive. This dispensed adhesive is used to couple the signatures with a respective cover (e.g., outer binding), thereby encapsulating signatures with the cover via the adhesive and, thus, binding the signatures to the cover while allowing ease of removal/separation of the signatures from the cover when the book is later de-collated for distribution (e.g., at a school classroom, etc.).

In some examples, a retention tab is applied to opposing ends of the cover to further secure/retain the signatures within the cover. In some examples, the retention tab has an adhesive surface(s) to couple the retention tab to the opposing ends of the cover and/or the signatures. In some examples, a low tack adhesive is applied to only a portion of the length of the signatures.

As used herein, the term "book" may refer to a stack of one or more signatures or an assembled book including a stack of a plurality of signatures along with and/or coupled to an outer cover. As used herein, "length" of a book and/or signatures refers to a length along a spine (which, e.g., is aligned along a direction of travel of the book along a conveyor).

Turning now to the figures, FIG. 1 illustrates an example book 100 produced in accordance with the teachings of this disclosure. The example book 100 includes an outer cover 102 and signatures 104 in a stacked arrangement relative to one another and aligned relative to the outer cover 102. The outer cover 102 of the illustrated example includes opposing ends 105, cover surfaces (e.g., front and rear cover surfaces, legs) 106 and a spine 108. As shown in FIG. 1, the outer cover 102 is folded in a square back binding configuration that is defined by folds 112, 114 that, in turn, define the spine 108. In some examples, a retaining tab 110 is used to at least partially restrain the signatures 104 within the outer cover 102 and/or to keep the opposing ends 105 constrained relative to one another.

As mentioned above, in some examples, the example book 100 also includes a retention tab (e.g., a wafer seal) 110 that can be easily removed and/or torn prior to distribution of the signatures 104. In such examples, the retention tab may have an adhesive on a side that is used to couple opposing ends 105 of the cover 102 to the retention tab, thereby constraining the signatures 104 to the cover 102 prior to the distribution of the signatures 104. In some examples, the retention tab 110 has adhesive only applied to portions that contact the opposing ends 105 of the cover 102, for example. In some examples, the retention tab 110 has circular or semi-circular shaped ends, but any suitable or desired shape (e.g., rectangular) may be used. In some examples, the retention tab 110 has an adhesive side/portion that has enough adhesion to bind the signatures 104 but is also easily torn and/or removed. In terms of dimensions, the retention tab 110 of the illustrated example has a diameter of approximately 2.5 inches (in.). However, in other examples, other suitable or desired dimensions may be used.

Additionally or alternatively, the retention tab 110 may be applied at any of the other edges of the signatures 104 (e.g., the top and/or bottom edges of the signatures 104 in the view of FIG. 1). In some examples, the retention tab 110 may also be coupled to the signatures 110 via an adhesive of the retention tab. In some examples, multiple retention tabs 110 may be used to constrain the signatures 104 within the cover 102 in multiple directions. Additionally or alternatively, the cover 102 may have and/or retain adhesive to couple portions of the retention tab 110 to the cover 102.

In some examples, the cover 102 includes a printing portion (e.g., custom printing portion) 120. For example, an identifier such as a name and/or an address may be printed onto the printing portion 120 after the signatures 104 and/or retention tab 110 has been assembled to the cover 102. For example, identifiers printed onto the printing portion 120 may include, but are not limited to, names, addresses, school grades, specific classes, grade levels, content specific information and/or quantities (e.g., specific quantities of the signatures 104 within the respective book 100), etc. and/or any other desired human or machine readable indicia.

While the outer cover 102 is shown in a square back binding configuration, the outer cover 102 may also be configured and/or shaped as a simple fold (e.g., a single fold spine, etc.), or any other appropriate shape or fold. For example, in some examples, the spine 108 may not exhibit a square back spine and, instead, have a rounded fold.

Figure 2A:
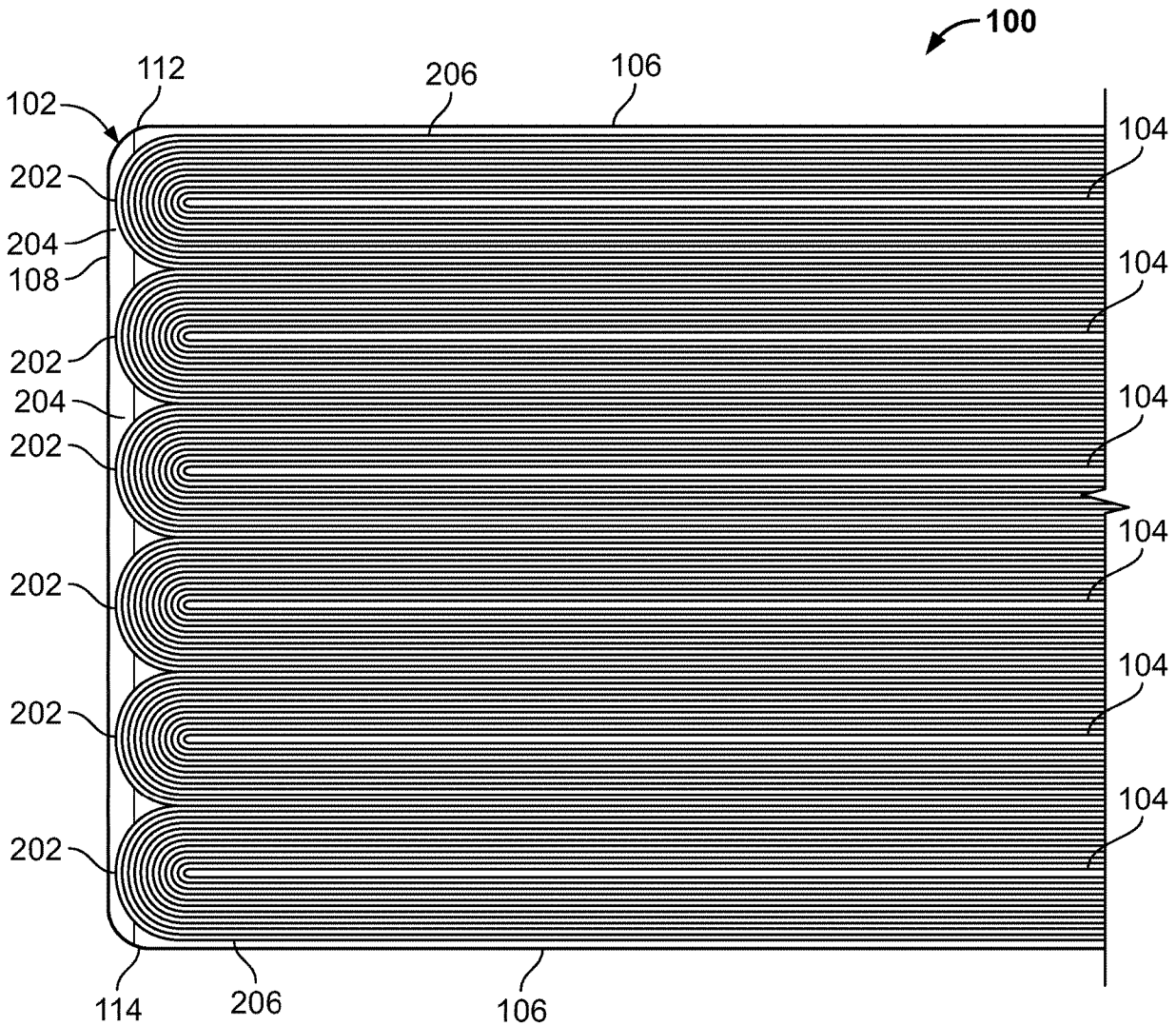
FIG. 2A is a detailed cross-sectional view of the example book of FIG. 1.

FIG. 2A is a detailed cross-sectional view of the example book 100 of FIG. 1. As illustrated in FIG. 2A, the signatures 104 are positioned in a stacked arrangement relative to the cover 102 and between the cover surfaces 106. Further, respective spines 202 of the signatures 104 are positioned proximate the spine 108 of the outer cover 102. In particular, the spines (e.g., backbones) 202 of the illustrated example are coupled to an inner surface of the spine 108 via a low tack adhesive (e.g., an adhesive pattern of low tack adhesive with a corresponding surface area) 204, which extends between the folds 112, 114 in this example. In particular, the low tack adhesive 204 disposed between the spine 108, which is defined by the cover 102, and the spine(s) 202, thereby defining a removable (e.g., decoupleable) adhesive pattern therebetween. For example, a first signature of the signatures 104 and a second signature of the signatures 104 may be coupled to the spine via first and second adhesive patterns, respectively, of the low tack adhesive 204.

In some examples, the first and second adhesive patterns may have different surface areas and/or areas of coupling (e.g., to vary a degree of force necessary to remove the signatures 104). In some examples, inner portions of the cover surfaces 106 and covers 206 of the signatures 104 are not applied with the adhesive 204. In other examples, inner portions (e.g., legs) of the covers 106 may include the adhesive 204 and/or another removable adhesive pattern between the signatures 104 and these inner portions. As will be described below in connection with FIGS. 4 and 6 below, the low tack adhesive 204 may be applied along a portion of a surface of the signatures 104 (e.g., a portion of surface(s) defined by the spine(s) 202). Also, in some examples, the low tack adhesive 204 is disposed between the spine(s) or backbone(s) 202 and the spine 108 such that the adhesive 204 is disposed between opposite ends of the signatures 104 along their respective lengths (e.g., along a length of their respective spines 202) and, in some examples, does not extend fully to the end of the signature spines 202.

The placement and/or positioning of the low tack adhesive 204 to couple the signatures 104 along the spine 108 of the cover 102 allows for an easy and organized removal of the signatures 104 from the cover 102. In particular, as the signatures 104 of the illustrated example are pulled at distal ends of the signatures 104 opposite the spine 108, the signatures 104 separate from the cover 102 without a significant amount of force. In this example, the low tack adhesive 204 remains with the spine 108 of the cover 102, thereby maintaining a relatively clean appearance of the signatures 104 after separation from the cover 102. In this example, the curvature of the spines (e.g., backbones) 202 of the signatures 104 substantially prevents the low tack adhesive 204 from filling spaces between the signatures 104. However, in some examples, the low tack adhesive 204 may partially fill the spaces between the signatures 104 while continuing to facilitate removal of the signatures 104, and the low tack adhesive 204 remains coupled to the spine 108 upon removal of the signatures 104.

Figure 2B:
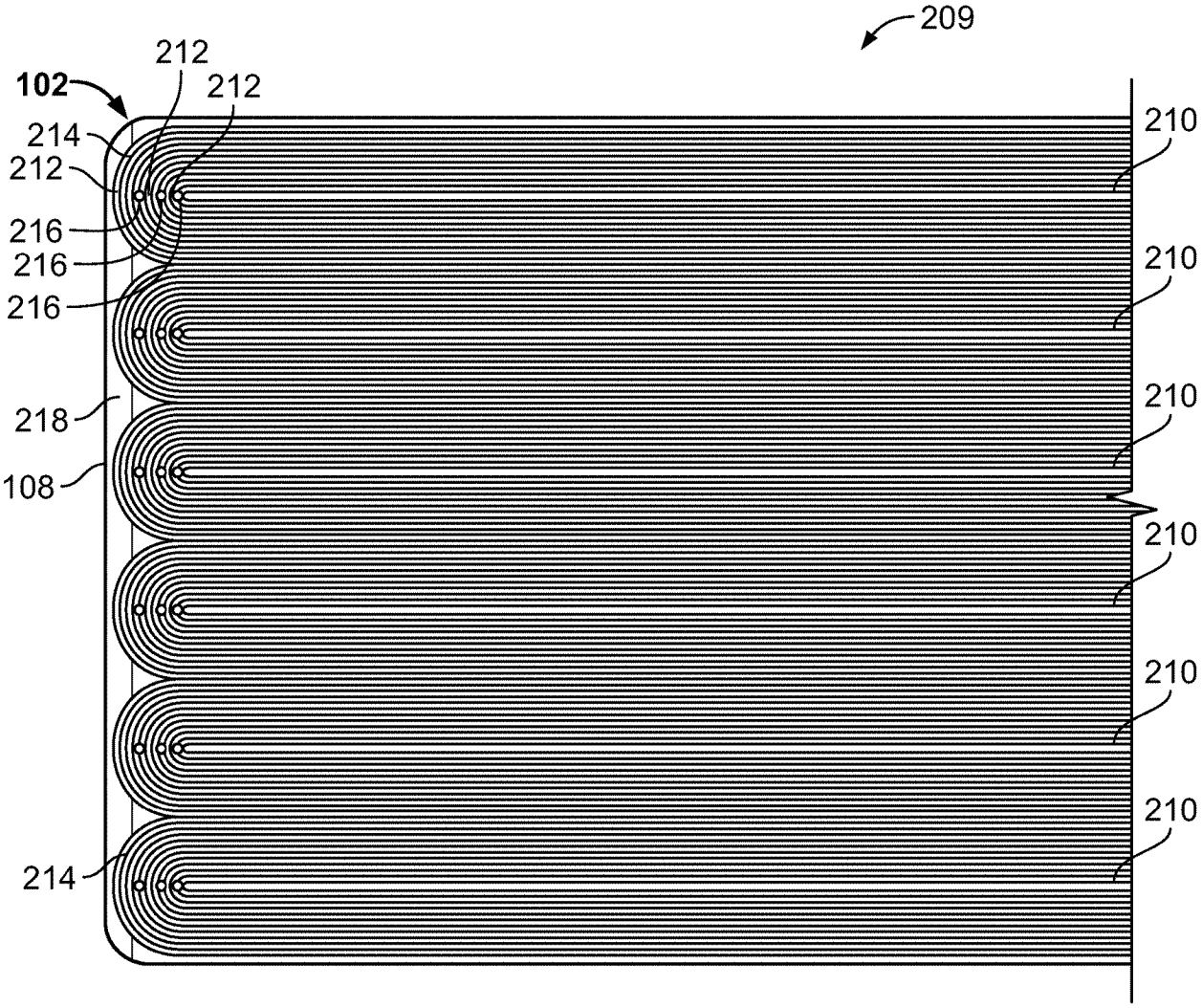
FIG. 2B is a detailed cross-sectional view of an alternative example book.

FIG. 2B is a view similar to the illustrated example of FIG. 2A, but depicts an alternative example book 209, which also has the outer cover 102, but includes de-collatable signatures 210 with removable ribbons 212, which are a subset of distributable signatures of the signatures 210, in contrast to the example signatures 104 of FIGS. 1 and 2A. In particular, the ribbons 212 of the illustrated example define embedded removable signatures within the signatures 210. For example, if a signature is a collection of fliers, the ribbons may be individual pages that can be separated from one another and distributed as desired. In this example, the de-collatable signatures 210 of the illustrated example include the removable ribbons 212 in an embedded arrangement to one another (e.g., the ribbons 212 are folded within one another). In particular, the ribbons 212 are folded within one another and each of the ribbons 212 are individually bound via an adhesive 216. In other examples, the ribbons 212 are not embedded within one another (e.g., the ribbons are in a stacked arrangement) and, as a result, the ribbons 212 may be removed independently of one another and not in a particular order (e.g., one of the ribbons 212 may be removed without necessarily having to remove another ribbon 212 prior or simultaneously). Additionally or alternatively, the ribbons 212 may be coupled together via an adhesive pattern. In other examples, other chemical or mechanical fasteners (e.g., staples) may bind ribbons together.

In a similar fashion to the example shown in FIG. 2A, an outermost ribbon (e.g., the ribbon adjacent a respective cover and/or a backbone of the outermost ribbon) 214 of each of the ribbons 212 defines an outer portion of the respective signature 210 to be coupled to the cover 102 via a low tack adhesive (e.g., an adhesive pattern of low tack adhesive with a corresponding surface area) 218, for example.

In some examples, a first signature of the signatures 210 may include first and second ribbons of the ribbons 212, in which the first ribbon is disposed within the second ribbon such that the second ribbon defines a first backbone. Likewise, a second signature of the signatures 210 may include third and fourth ribbons of the ribbons 212, in which the third ribbon is embedded in the fourth ribbon such that the fourth ribbon defines a second backbone. In this example, a first removable pattern of the adhesive 218 couples the first backbone to the spine 108 and a second removable pattern of the adhesive 218 couples the second backbone to the spine 108.

Because the ribbons 212 defining the signatures 210 of the illustrated example are embedded within one another. After the signature 210 is removed from the cover 102 (e.g., in a similar fashion to the way that the signature 104 is removed from the cover 102 that is described above in connection with FIG. 2A), the individual ribbons 212 are able to be separated from one another. In particular, each of the ribbons 212 may be pulled from another of the ribbons 212 until the outermost ribbon 214 is remaining, which may also be distributed. In some examples, the adhesive 216 that binds the ribbons 212 is also a low tack adhesive, thereby defining an additional step of removal and/or separation (e.g., a separable ribbon).

In some examples, each of the signatures 210 include covers (e.g., outer covers, etc.) enclosing the ribbons 212 and/or defining exterior surfaces of each of the ribbons 212 (e.g., a single fold and single sheet cover). In other words, the outermost ribbon 214 may be define a ribbon cover that depicts information instead of a being a ribbon for distribution, for example. In particular, the ribbon covers enclosing the ribbons 212 may include order forms corresponding to each set of the ribbons 212 and/or a summary of the ribbons 212 defining the respective signature 210.

Figure 3:
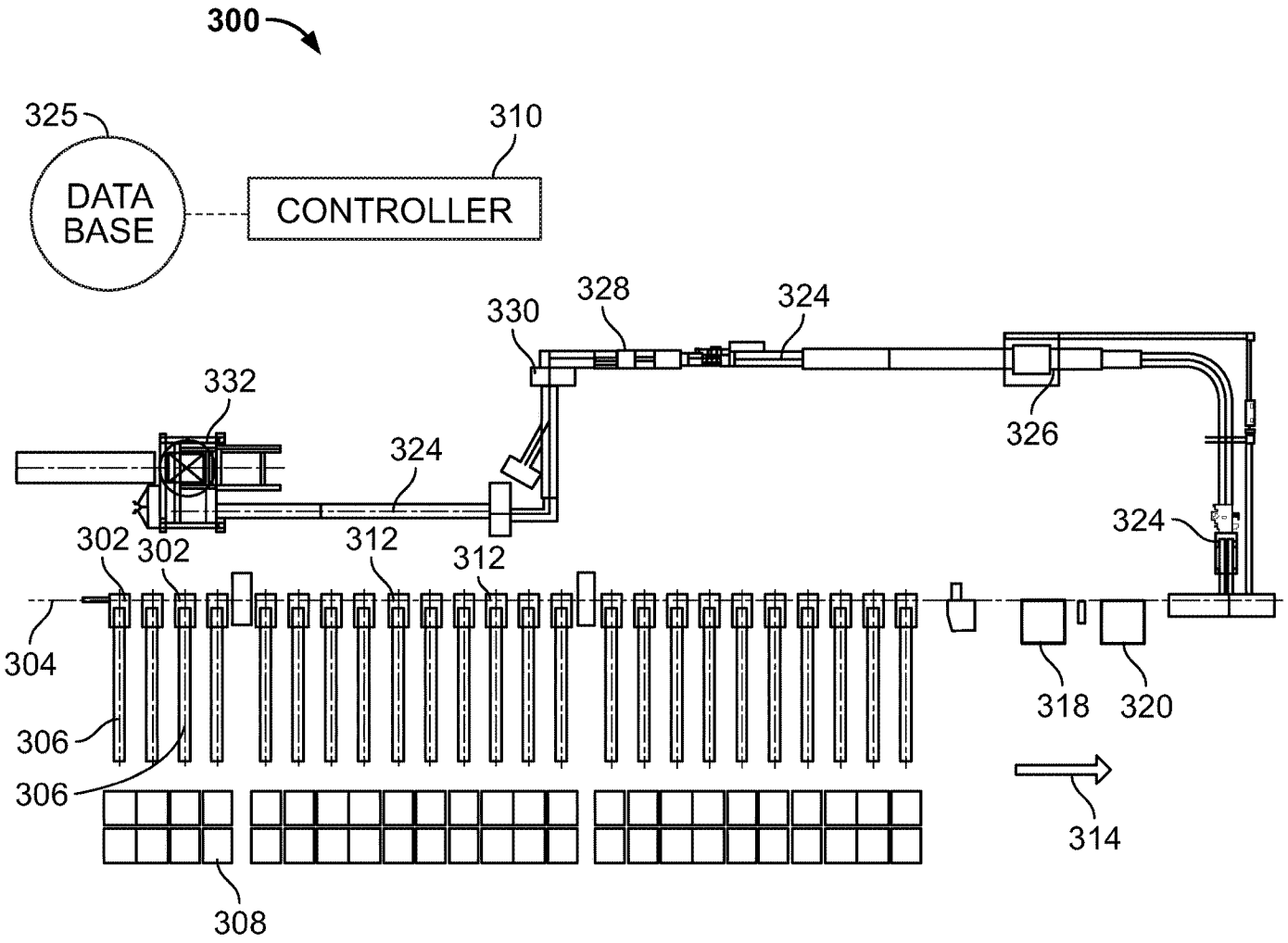
FIG. 3 is a schematic illustration of an example binding line that can be used to produce the example books disclosed herein.

FIG. 3 is a schematic illustration of an example binding line 300 that can be used to produce the example books disclosed herein such as the example books 100, 209 described above in connection with FIGS. 1-2B. As illustrated in FIG. 3, in some examples, the example binding line 300 includes signature feeders 302 that are positioned near or at a conveyor (e.g., a conveyor chain) 304. In some examples, signatures provided to the signature feeders 302 already have ribbons assembled within. The binding line 300 may include any number of the signature feeders 302, which may be in any suitable position relative to the conveyor 304. In the illustrated example of FIG. 3, the signature feeders 302 are coupled to hoppers 306 that hold at least one signature to be fed to the signature feeders 302. Additionally, in the illustrated example, at least one of the hoppers 306 is coupled to at least one additional hopper 308 positioned substantially perpendicular to, parallel to, behind, or otherwise proximate to at least one of the hoppers 306. If the additional hopper 308 is coupled to at least one of the hoppers 306 (e.g., two additional hoppers 308 are coupled to the hopper 306), each of the signature feeders 302 may be able to feed different signatures onto the conveyor when, for example, the first additional hopper 308 has signatures associated with a first book and the second additional hopper 308 has signatures associated with a second book. The signatures may be any size such as, for example, large formats or table-sized books.

In this example, the binding line 300 includes a controller 310 that is communicatively coupled to the signature feeders 302 and may be communicatively coupled to any other device within the example binding line 300. In operation, the conveyor 304 moves pockets 312 in a direction generally indicated by arrow 314 in front of the signature feeders 302. As the pockets 312 move in proximity to the front of the signature feeders 302, the respective signature feeders 302 may deliver at least one signature onto one or more of the pockets 312 to form a book (e.g., a flier, a magazine, a pamphlet, etc.). As the pockets 312 move in front of the different signature feeders 302, the signatures may be stacked on top of one another, thereby defining a signature stack.

In some examples, some of the pockets 312 may be associated with a first book and some of the other pockets 312 may be associated with a second book. As such, signatures that correspond to the first book are delivered to a first pocket 312 and signatures that correspond to a second book are delivered to a second pocket 312. In some examples, the first book may be a first size (e.g., 100 pages, a first spine length, etc.) and the second book may be a second size (e.g., 200 pages, a second spine length, etc.). Furthermore, a spine length of the first book may be different than a spine length of the second book.

In the illustrated example, the controller 310 causes an adhesive station 318 to dispense adhesive to the stacked signatures as the signatures move on the conveyor 304 through the adhesive station 318. For example, the adhesive station 318 dispenses adhesive adjacent spines of the signatures when the signatures are stacked together. A reference database 325 accessed by the controller 110 may include parameters such as what books are being produced, necessary signatures to produce a particular book, rates of travel of the conveyors 304 and/or a conveyor 324, quantity of books to be produced, length of each book, a production sequence, whether books should have staples and/or adhesive applied, etc. In other examples, the adhesive station 318 may apply adhesive to the covers instead of the signatures prior to the covers and the signatures being assembled together.

In the illustrated example, the binding line 300 includes an assembler 320 that places the cover to be coupled to the respective signatures. In some examples, the assembler 320 also places a retention tab (e.g., the retention tab 110) at opposing ends of the cover to retain the signatures to the cover after the cover and the signatures are coupled/assembled together. In some examples, the retention tab and/or coupling of the retention tab to the cover is verified via an inspection system (e.g., a visual inspection system).

In some examples, after the books are placed onto the conveyor 324, additional information such as identifiers (e.g., the identifiers of the printing zone 120 of FIG. 1, unique identifiers designating specific information such as a recipient and/or address of the recipient, etc.) may be printed onto the books at a printer 326. In some examples, the conveyor 324 includes a trimmer station 328 to trim at least one edge of the de-collatable books moving along the conveyor 324. In this example, the signatures and the cover are trimmed by the trimmer station 328 (e.g., trimming processes are not bypassed). However, in other examples, the signatures and the cover are not trimmed at the trimmer station 328 (e.g., trimming processes are bypassed).

In this example, the books then move toward a stacker 330, which sorts and/or packages the different books. The example binding line 300 may produce any number of books (e.g., a first book, a second book, a third book, a fourth book, etc.) in the same production run. In the illustrated example, after the different books are packaged, the packages may move along the conveyor 324 to a palletizer 332, which places the different packages onto pallets for shipment.

Figure 4:
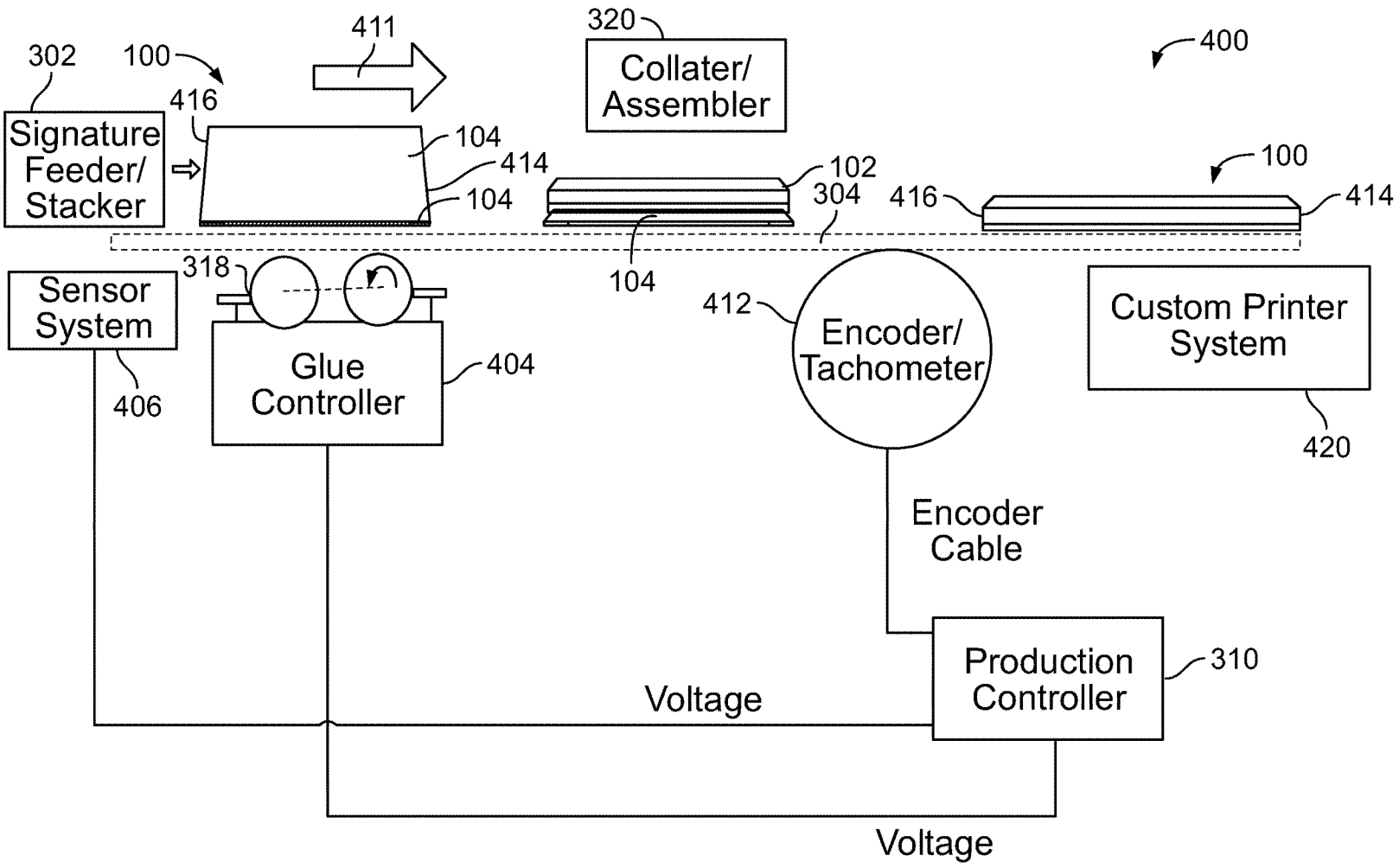
FIG. 4 is a schematic illustration of an example de-collatable binding system of the example binding line of FIG. 3.

FIG. 4 is a schematic illustration of a de-collatable binding system 400 of the example binding line 300 of FIG. 3. In the illustrated example of FIG. 4, the controller 310 is communicatively coupled to an encoder (e.g., tachometer) 412, a sensor system 406 and a glue controller 404. In some examples, the encoder 412 is used to detect the rate of travel and/or the distance of travel of the conveyor 304. The sensor 406 of the illustrated example is used to identify when a leading edge 414 and/or a trailing edge 416 of a book 100 moves past a location on the binding line 300 and the glue controller 404 is associated with operating the adhesive dispenser 318.

In operation, to determine a time-based positional change of the book 100, which is composed of multiple signatures 104 stacked together, as the book 100 moves in the direction generally indicated by an arrow 411, the encoder 412 determines and/or transmits a rate of travel and/or a distance of travel of the conveyor 304 to the controller 310, based on, for example, rotation of the encoder 412. In some examples, to determine when the book 100 is to be positioned adjacent the adhesive dispenser 318, the sensor 406 signals the controller 310 that the respective edges 414, 416 have moved past the sensor system 406 and the positional information from the sensor system 406 is used to estimate when the book 100 will move over the adhesive dispenser 318. In some examples, the sensor system 406 may be approximately two feet in front of the adhesive dispenser 318 or any other appropriate distance. As will be discussed in detail below in connection with FIG. 6, the adhesive dispenser 318 may be rotated and/or displaced to vary whether one or more rollers of the adhesive dispenser contacts the book 100 as the book travels past the adhesive dispenser 318.

In some examples, to dispense adhesive to the signatures 104, the controller 310 determines when to cause the adhesive dispenser 318 to dispense adhesive to portions of spines 202 of the signatures (e.g., stacked signatures) 104 based on when the sensor system 406 identified the leading and/or trailing edges 414, 416, the rate of travel and/or the distance of travel of the conveyor 304. In other examples, if the encoder 412 is not included, the controller 310 determines when to cause the adhesive dispenser 418 to dispense adhesive to the signatures 104 and/or portions of the length of the signatures 104 based on a pre-defined speed of the conveyor 304. Additionally or alternatively, to determine when to cause the adhesive dispenser 418 to dispense adhesive to the interior of the book 100, the controller 310 may use the sensor 406 output associated with the leading edge 414, a length of the book 100 stored in the database 325, the rate of travel of the conveyor 304 and/or the distance of travel of the conveyor 304. As the signatures 104 travel over the adhesive dispenser 318, the controller 310 causes the adhesive dispenser 318 to dispense adhesive along at least portion of the length of the signatures (e.g., between the leading edge 414 and the trailing edge 416). Alternatively, in some examples, the adhesive dispenser 318 applies adhesive to the cover 102 instead of the signatures 104.

After the adhesive dispenser 318 applies adhesive to the signatures 104 (e.g., along portions of lengths of the signatures 104), the signatures 104 are assembled to the cover 102 at the collater/assembler 320. In some examples, the retention tab 110 is also assembled (e.g., applied via an adhesive of the retention tab 110) to the book 100 at the collater/assembler 320. In some examples, the book 100 is printed at a custom printing system (e.g., a printer controller) 420 with identifiers at a printing location on the book 100 (e.g., the printing location 120 of FIG. 1).

Figure 5:
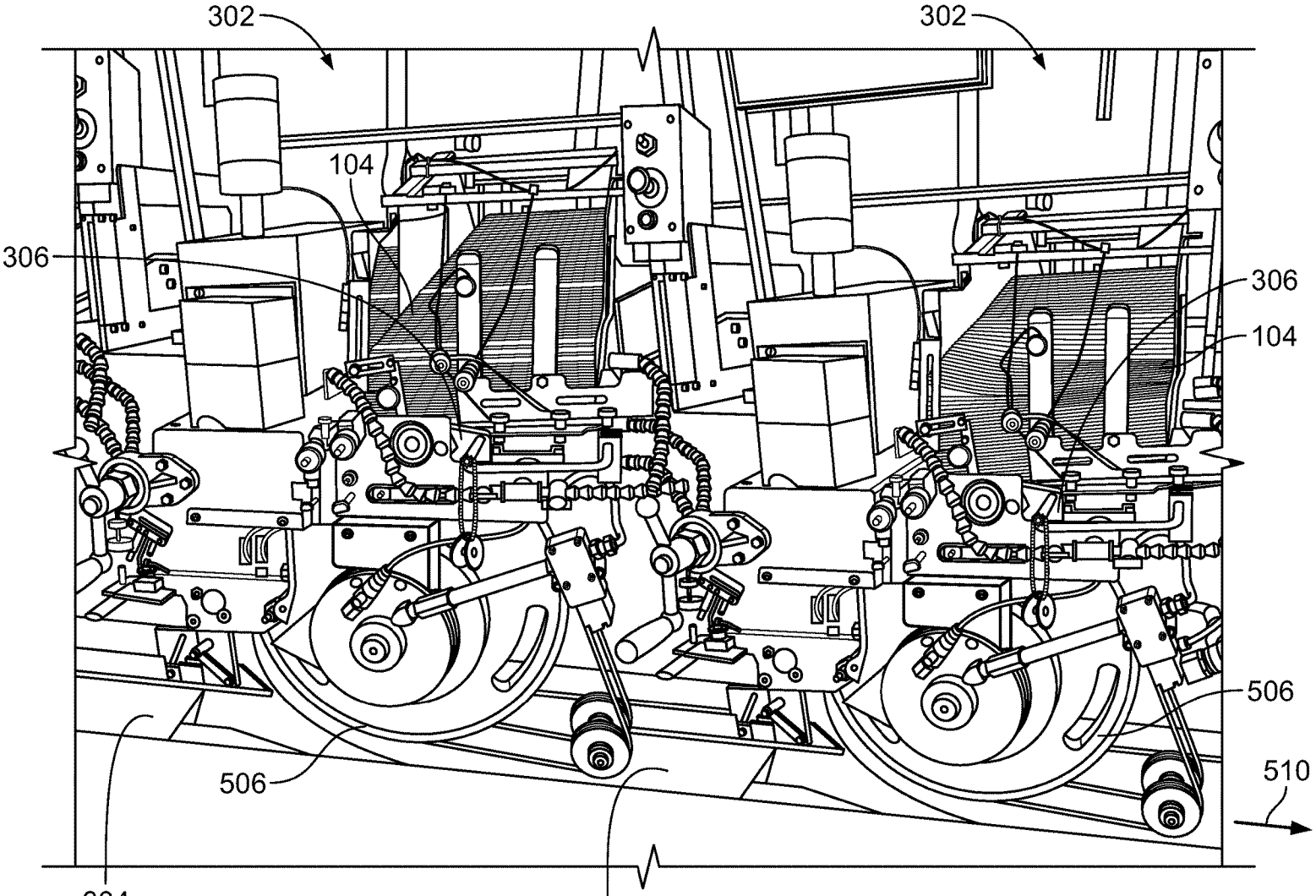
FIG. 5 illustrates signature stacker/assemblers of FIGS. 3 and 4.

FIG. 5 illustrates the signature stacker/assemblers 302 of FIGS. 3 and 4. As can be seen in the view of FIG. 5, the signature stackers 302 are arranged along different positions of the conveyer 304 and include the aforementioned signature hoppers 306, and signature rollers 506 that stack the signatures 104 from the signature hoppers 306 together to define the book(s) 100 as the book(s) 100 travel along the conveyor 304 in direction generally indicated by an arrow 510. The distinct signature/stacker assemblers 302 of the illustrated example enable different signatures 104 to be stacked together. In particular, the signatures 104 may vary by content and/or ribbons contained within, for example. In this example, the signatures 104 are stacked together based on which of the signatures 104 are fed into each of the different hoppers 306. In some examples, different signatures 104 at the different hoppers 306 have different ribbons contained within and/or different numbers of ribbons stacked together.

Figure 6:
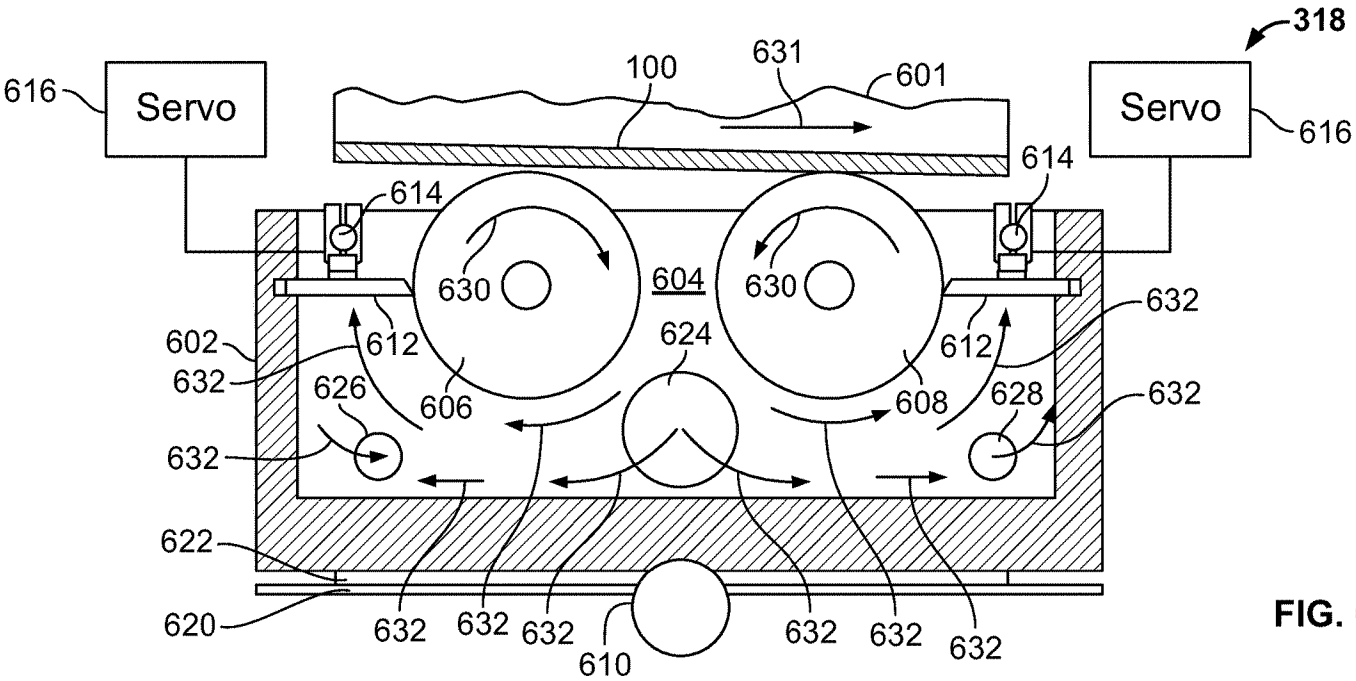
FIG. 6 is a cross-sectional view of an example adhesive station of FIGS. 3 and 4.

FIG. 6 is a cross-sectional view of the example adhesive station 318 of FIGS. 3 and 4. The example adhesive station 318 includes a clamp 601 to hold and/or restrain the book 100, which includes numerous signatures 104 stacked together, but not a cover 102 at this stage of the example binding process. The example adhesive station 318 also includes an enclosure (e.g., a tank, a storage reservoir, etc.) 602, which holds an adhesive 604 (e.g., a low tack adhesive and/or pressure sensitive adhesive), first and second roller (e.g., applicator rollers, adhesive rollers, drum rollers, etc.) 606, 608, a pivot 610 for the enclosure 602, control blades 612 and blade movement actuators 614. In some examples, the adhesive station 318 also includes servo (e.g., electromagnetic servos, solenoids, etc.) 616. In some examples, the example adhesive station 318 also includes an applicator heater 620 and a heater clamp 622. In this example, the rollers 606, 608 rotate in a direction generally indicated by arrows 630. However, in this example, only the roller 608 is positioned close enough to the book 100 to apply adhesive and, thus, only the roller 608 applies the adhesive 604 to the book 100 as the book 100 moves in a direction generally indicated by an arrow 631 (e.g., a single roller application of adhesive).

To apply the adhesive 604 to only a portion of the book 100 and/or a portion of the spines of the signatures 104, the respective blade 612 of the illustrated example is moved/displaced away from the roller 608 in a generally horizontal direction in the view of FIG. 6 as the roller 608 rotates in the direction of the arrow 630, thereby drawing up the adhesive 604 onto an outer cylindrical surface of the roller 608 and then to the book 100 via surface tension of the adhesive 604 and/or motion of the roller 608 as the book moves along the conveyor 304 while the book 100 is clamped by the clamp 601. In this example, the clamp 601 presses and/or applies a pressure to the book 100 as the book 100 contacts the roller 608. The manner in which the adhesive 604 is applied to a portion of the length of the book 100 is described in greater detail below in connection with FIG. 7.

In this example, to control the motion of the blade 612, the blade 612 is controlled by the servo 616, which directs motion of the blade 612 based on timing and/or sensor data (e.g., sensor data from the sensor system 406 of FIG. 4). Additionally or alternatively, in some examples, the blade 612 is moved by motion of a cam, which may be based on motion of the conveyor 304.

In this example, to vary a degree of engagement of the rollers 606, 608 to the book 100, the reservoir 602 is pivoted slightly about the pivot 610 to move the roller 608 closer to the book 100 for application of the adhesive 604. In a different application for another book, the reservoir 602 may be angled and/or pivoted so that both of the rollers 606, 608 contact the book so that more adhesive may be applied (e.g., for examples with permanent adhesive) and/or to adjust a rate of movement of the book past the rollers 606, 608. Alternatively, one or more of the rollers 606, 608 may be displaced independently relative to the reservoir 602 to position the roller 608 relatively closer to the book 100 than the roller 606, for example, so that only the roller 608 only applies the low tack adhesive to allow controlled application of the low tack adhesive along portions of the book 100. Alternatively, a portion of the conveyor 304 may be angled relative to the roller 608, the roller 606 and/or the reservoir 602 to vary an amount of engagement/contact between one or more of the rollers 606, 608 and the book 100.

To circulate the adhesive 604 within the enclosure 602 prior to application of the adhesive 604 to the book 100, the enclosure 602 of the illustrated example includes an adhesive inlet 624 as well as adhesive returns 626, 628. In this example, arrows 632 generally indicate a flow pattern of the adhesive 604 to maintain desired adhesion properties of the adhesive 604. In some examples, the adhesive 604 is a Swift® brand adhesive with a grade of 84491 or 84700 and is maintained at a certain temperature range (e.g., 300-400° F.) by the heater 620 proximate the enclosure 602. However, the adhesive 604 may be any other appropriate adhesive with low tack properties and/or any other properties favorable to easy removal of the signatures 104.

Figure 7:
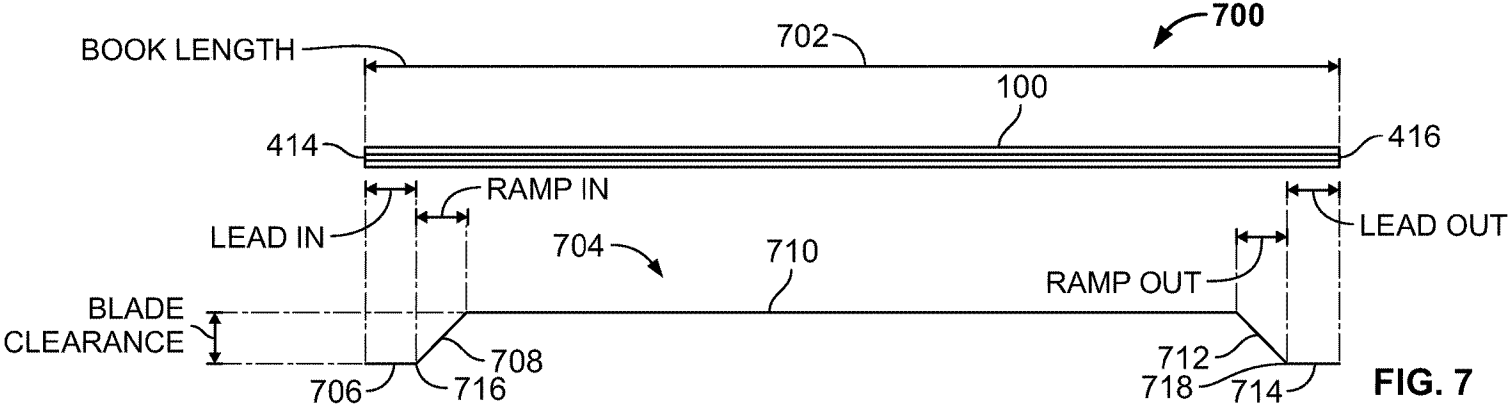
FIG. 7 depicts an example blade profile of the adhesive station of FIGS. 3 and 4.

FIG. 7 depicts an example blade profile 700 of the adhesive station 318 of FIGS. 3 and 4 related to a length dimension 702 of the book 100. In the view of FIG. 7, the example blade profile 700 is displayed alongside the length dimension 702 and includes an example displacement curve 704, which includes a lead-in portion 706, a ramp-in portion 708, a full application portion 710 where the blade 612 is moved furthest from the cylinder 608, a ramp out portion 712 and a lead out portion 714. The example blade profile 700 allows a portion of the length of the book 100 indicated by the aforementioned dimension 702. In particular, the example blade profile 700 defines an application of adhesive (e.g., the adhesive 604) from a first point 716 to at a first distance from the leading edge 414 of the book 100 to a second point 718 at a second distance from the trailing edge 416 of the book 100, thereby applying the adhesive to a portion of the length of the book 100. In some examples, the first and second distances are approximately 1.75 inches each while the portion of the length with the applied adhesive is approximately 7 in. (i.e., the distance from the first point 716 to the second point 718). In some examples, the adhesive is applied in a portion of the length that is approximately 5-9 in. The dimensions described herein are only examples and the dimensions may vary based on application, adhesive and/or desired removal force of signatures.

While the example blade profile 700 is generally shown in the illustrated example as a trapezoidal function based on the corresponding ramp in portion 708 and the ramp out portion 710, the example profile 700 is not exhaustive and any appropriate blade function may be used. For example, the ramp in portion 708 and the ramp out portion 710 may be curved or parabolic in nature. Additionally or alternatively, the ramp in portion 708 and the ramp out portion 710 may include inflection points and/or multiple curves.

Figure 8:
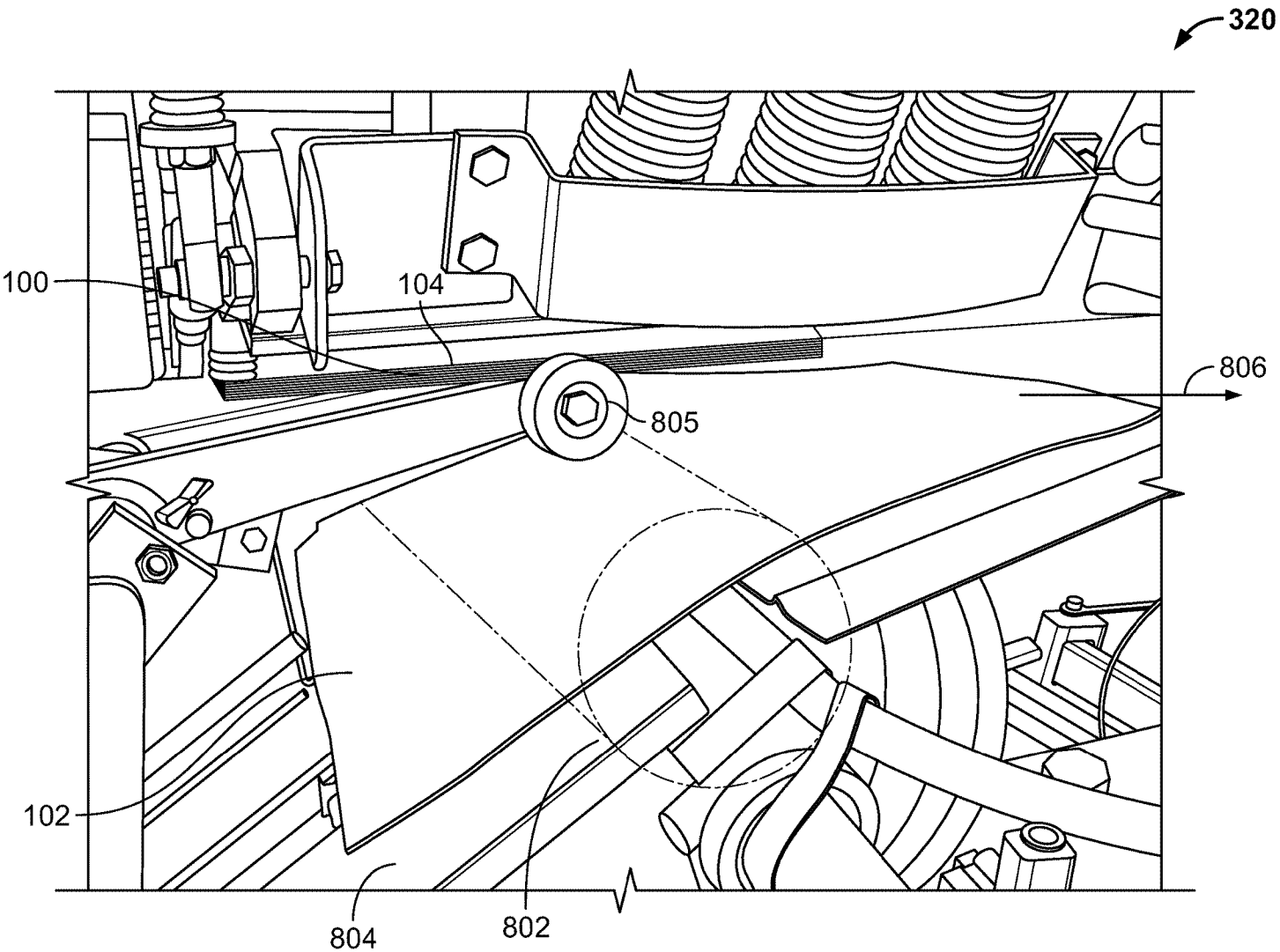
FIG. 8 is a view of an example assembler of FIGS. 3 and 4.

FIG. 8 is a view of an example assembler 320 of FIGS. 3 and 4. In this example, the cover 102 is moved by a roller 802 and guided by a ramp 804 and/or a tension roller 805 to be moved towards the book 100 in a direction indicated by an arrow 806. After the cover 102 is brought into position relative of the book 100, the cover 102 is folded around the book 100. In particular, the cover 102 is folded around the stacked signatures 104 so that the adhesive applied to the stacked signatures 104 couples the cover 102 to the stacked signatures 104. In some examples, the signatures 104 and/or a block positioning the signatures 104 are distanced from the roller 802 by approximately 0.020 in. as the cover 102 is placed into position to be assembled to the signatures 104. The aforementioned example distance dimension is only an example, and any appropriate distance may be used based on dimensions of the signatures 104 and/or the cover 102, properties of the adhesive and/or a rate of assembly of the cover 102 to the signatures 104.

In some examples, a pressure is applied to the cover 102 as the cover 102 is folded around the book 100. While the adhesive is applied to the stacked signatures 104 first in this example, additionally or alternatively, the adhesive may be applied to the cover 102 prior to the cover 102 and the signatures 104 being coupled together via the adhesive. For example, the adhesive may be applied to at least portions of the cover 102, but not the signatures 104.

While an example manner of implementing the example de-collatable binding system 300 of FIGS. 3 and 5-8 is illustrated in FIG. 4, one or more of the elements, processes and/or devices illustrated in FIG. 4 may be combined, divided, re-arranged, omitted, eliminated and/or implemented in any other way. Further, the example production controller 310, the example collater/assembler 320, the example signature feeder/stacker 302, the example glue controller 404, the example sensor system 406, the example custom printing system 420 and/or, more generally, the example de-collatable binding system 400 of FIG. 4 may be implemented by hardware, software, firmware and/or any combination of hardware, software and/or firmware. Thus, for example, any of the example production controller 310, the example collater/assembler 320, the example signature feeder/stacker 302, the example glue controller 404, the example sensor system 406, the example custom printing system 420 and/or, more generally, the example de-collatable binding system 400 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example, production controller 310, the example collater/assembler 320, the example signature feeder/stacker 302, the example glue controller 404, the example sensor system 406, and/or the example custom printing system 420 is/are hereby expressly defined to include a tangible computer readable storage device or storage disk such as a memory, a digital versatile disk (DVD), a compact disk (CD), a Blu-ray disk, etc. storing the software and/or firmware. Further still, the example the example de-collatable binding system 400 of FIG. 4 may include one or more elements, processes and/or devices in addition to, or instead of, those illustrated in FIG. 4 and/or may include more than one of any or all of the illustrated elements, processes and devices.

Figure 9:
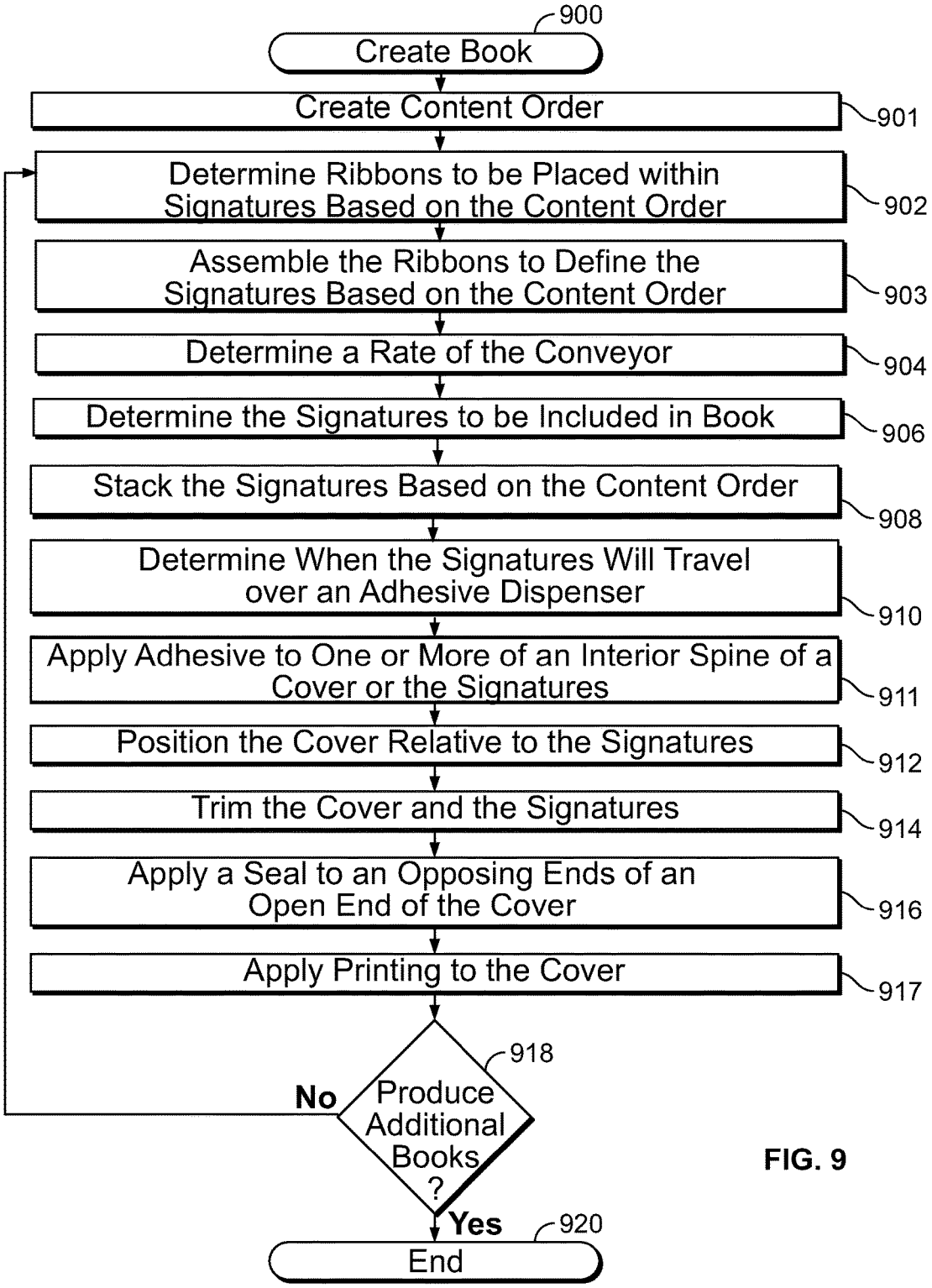
FIG. 9 is a flowchart representative of example machine readable instructions for implementing the examples disclosed herein.

A flowchart representative of example machine readable instructions for implementing the example de-collatable binding system(s) 300, 400 of FIGS. 3-8 is shown in FIG. 9. In this example, the machine readable instructions comprise a program for execution by a processor such as the processor 1012 shown in the example processor platform 1000 discussed below in connection with FIG. 10. The program may be embodied in software stored on a tangible computer readable storage medium such as a CD-ROM, a floppy disk, a hard drive, a digital versatile disk (DVD), a Blu-ray disk, or a memory associated with the processor 1012, but the entire program and/or parts thereof could alternatively be executed by a device other than the processor 1012 and/or embodied in firmware or dedicated hardware. Further, although the example programs is described with reference to the flowchart illustrated in FIG. 9, many other methods of implementing the example de-collatable binding system(s) 33, 400 may alternatively be used. For example, the order of execution of the blocks may be changed, and/or some of the blocks described may be changed, eliminated, or combined.

As mentioned above, the example processes of FIG. 9 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIG. 9 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

The example program of FIG. 9 begins at block 900 where a de-collatable book composed of signatures is to be produced (block 900). In this example, a content order is created to define production parameters of the de-collatable book and/or other books in a corresponding production sequence (block 901). In some examples, a content order (e.g., a bill of materials, a production order, etc.) of books to be produced is created and/or received by a production controller such as the production controller 310. In some examples, the content order is based on a database such as the database 325. In this example, the book is prepared for direct shipment to a classroom so that a teacher may distribute multiple copies of catalogs (e.g., book catalogs, etc.) to students. In some examples, other types of books may be also manufactured on the same line.

In some examples, ribbons corresponding to each of the signatures are determined (block 902). In some examples, this determination is based on the content order and used to coordinate ribbon gathering for signature assembly.

In some examples, the ribbons are assembled to define signatures (block 903). In particular, individual ribbons of the illustrated example are not bound (e.g., via staples, adhesive or other types of fasteners) to other ribbons, but embedded (folded and placed) within one another without any coupling.

In some examples, a rate of movement of a conveyor (e.g., the conveyor 304) is determined and/or measured from an encoder (block 904) using, for example, the encoder 412 of FIG. 4. In this example, the rate is determined for later determination and/or control of adhesive to be dispensed to the signatures of the book via a roller (e.g., the roller 608).

The signatures to be included in each of the books are determined (block 906). For example, the production controller 310 may be used to determine content order, bill of materials and/or quantities of signatures, etc. In this example, the set of signatures for the book is determined based on the content order. In some examples, this content order is used to direct signatures being provided to a conveyor from a hopper (e.g., the signature hopper 302).

The signatures are stacked together based on the content order (block 908). For example, the production controller 310 directs which signatures are to be provided to the signature feeders 302 and/or signature hoppers 306.

In some examples, it is determined when the signatures will travel over an adhesive station (block 910). For example, the production controller 310 determines when the signatures, which are stacked and aligned together in this example, will travel over the adhesive dispenser 318 and/or the roller 608. In some examples, this determination may occur by detecting a leading edge and/or a trailing edge of the signatures as the signatures move along the conveyor.

Adhesive is applied to one or more of an interior spine of a cover and/or to the exterior spine surfaces (backbones) of the signatures after the signatures are stacked and aligned together (block 911). For example, the adhesive station 318 is controlled/caused to dispense adhesive along a portion of the spine of the signatures 104 as the signatures 104 travel past the adhesive station 318. In particular, the blade 612 is moved relative to the adhesive roller 608, to control an amount of adhesive applied to defined portions of the signatures.

The cover is positioned relative to the signatures so that the signatures are aligned to the cover (block 912). In this example, the cover is folded around the signatures so that a resulting spine from the fold(s) is aligned/positioned relative to the spines of the signatures that have been dispensed/applied with adhesive. Additionally, or alternatively, the signatures are moved toward and/or into the cover to properly align/position the signatures relative to the cover 618.

In some examples, the cover and the signatures may be trimmed together (block 914). For example, at least one edge of the covers and the signatures may be trimmed at a trimmer (e.g., the trimmer station 328).

In some examples, a seal (e.g., the retention tab 110) is applied to opposing ends of an open end of the cover (block 916). In particular, the seal may be adhered to opposing ends of the cover near the open end to keep the signatures from moving and/or being removed from the cover.

In some examples, custom printing is applied to the respective completed books (block 917). For example, the printer 326 and/or the custom printer system 420 may be used to print individualized content on the books based on the content order.

Next, it is determined whether to produce additional books (block 918). In some examples, this determination may occur via a comparison of the content order and/or a database tracking of the books produced via the production controller. Additionally or alternatively, this determination may be based on the controller 310 automatically determining a work order of books (e.g., whether additional books are to be produced) based on the database 325.

If it is determined that the example process 900 is not to end (block 918), control of the process 900 returns to block 902. Otherwise, if it is determined that the process 900 is to end (block 918), the process 9200 ends (block 920).

Figure 10:
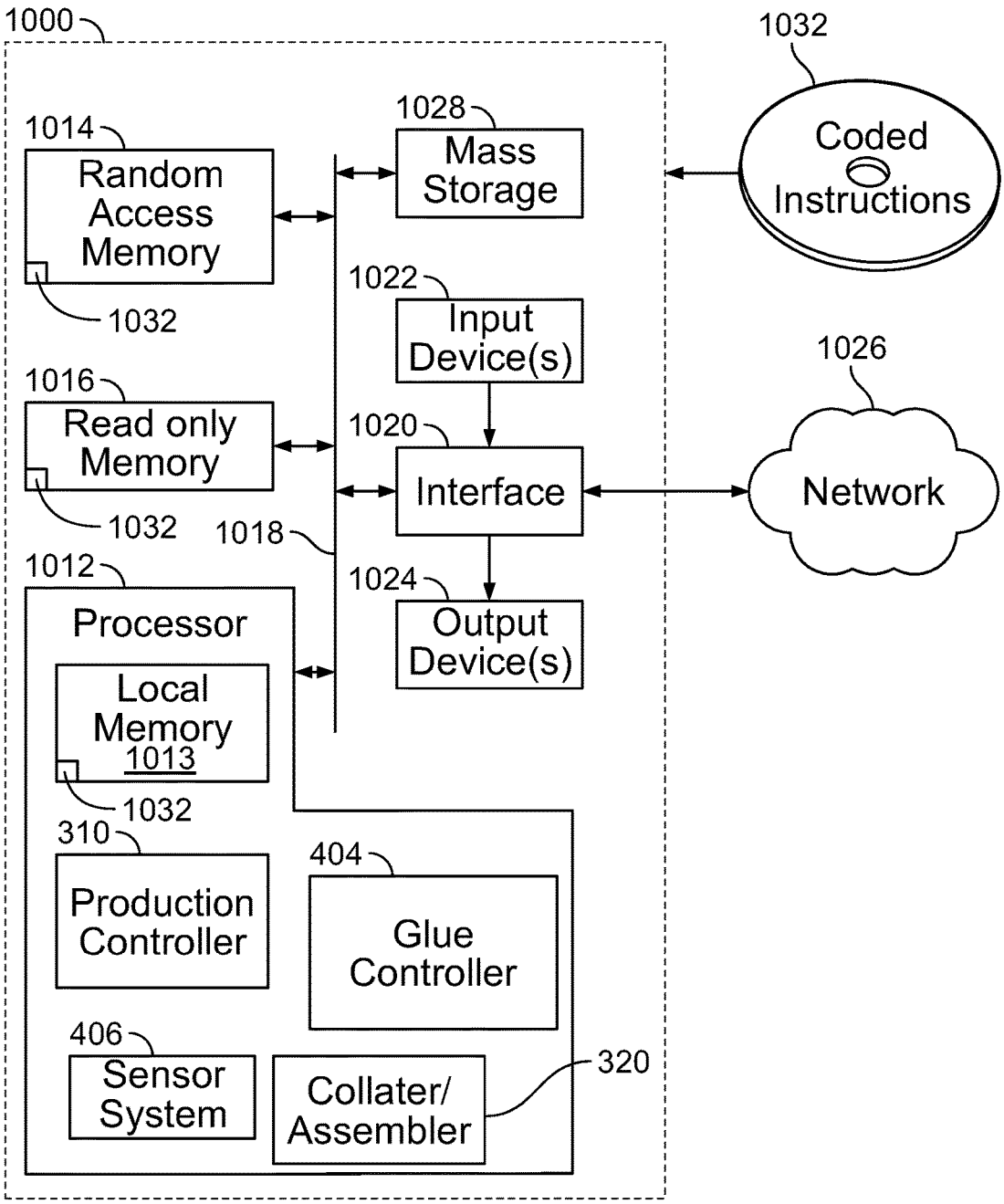
FIG. 10 is a block diagram of an example processor platform capable of executing the instructions of FIG. 9 to implement the example de-collatable binding system of FIG. 4.

FIG. 10 is a block diagram of an example processor platform 1000 capable of executing the instructions of FIG. 9 to implement the de-collatable binding system of FIG. 4. The processor platform 1000 can be, for example, a server, a personal computer, a mobile device (e.g., a cell phone, a smart phone, a tablet such as an iPad™), a personal digital assistant (PDA), an Internet appliance a digital video recorder, a set top box, or any other type of computing device.

The processor platform 1000 of the illustrated example includes a processor 1012. The processor 1012 of the illustrated example is hardware. For example, the processor 1012 can be implemented by one or more integrated circuits, logic circuits, microprocessors or controllers from any desired family or manufacturer.

The processor 1012 of the illustrated example includes a local memory 1013 (e.g., a cache). In this example, the processor 1012 also includes the production controller 310, the glue controller 404, the sensor system 406 and the collater/assembler 320. The processor 1012 of the illustrated example is in communication with a main memory including a volatile memory 1014 and a non-volatile memory 1016 via a bus 1018. The volatile memory 1014 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1016 may be implemented by flash memory and/or any other desired type of memory device. Access to the main memory 1014, 1016 is controlled by a memory controller.

The processor platform 1000 of the illustrated example also includes an interface circuit 1020. The interface circuit 1020 may be implemented by any type of interface standard, such as an Ethernet interface, a universal serial bus (USB), and/or a PCI express interface.

In the illustrated example, one or more input devices 1022 are connected to the interface circuit 1020. The input device (s) 1022 permit(s) a user to enter data and commands into the processor 1012. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1024 are also connected to the interface circuit 1020 of the illustrated example. The output devices 1024 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). The interface circuit 1020 of the illustrated example, thus, typically includes a graphics driver card, a graphics driver chip or a graphics driver processor.

The interface circuit 1020 of the illustrated example also includes a communication device such as a transmitter, a receiver, a transceiver, a modem and/or network interface card to facilitate exchange of data with external machines (e.g., computing devices of any kind) via a network 1026 (e.g., an Ethernet connection, a digital subscriber line (DSL), a telephone line, coaxial cable, a cellular telephone system, etc.).

The processor platform 1000 of the illustrated example also includes one or more mass storage devices 1028 for storing software and/or data. Examples of such mass storage devices 1028 include floppy disk drives, hard drive disks, compact disk drives, Blu-ray disk drives, RAID systems, and digital versatile disk (DVD) drives.

The coded instructions 1032 of FIG. 9 may be stored in the mass storage device 1028, in the volatile memory 1014, in the non-volatile memory 1016, and/or on a removable tangible computer readable storage medium such as a CD or DVD.

An example apparatus includes a cover defining a spine and signatures disposed within the cover. The example apparatus also includes a low tack adhesive disposed between the spine of the cover and the signatures to facilitate removal of the signatures from the cover.

In some examples, the example apparatus also includes a retention tab coupled to opposing ends of the cover to retain the signatures within the cover. In some examples, upon removal of one or more of the signatures, the low tack adhesive decouples from the one or more signatures and remains disposed on the spine.

In some examples, the signatures are defined by a plurality of ribbons. In some examples, outer ribbons of the plurality of ribbons are coupled to the spine via the low tack adhesive. In some examples, at least some of the plurality of ribbons of the signatures are embedded within one another.

In some examples, the low tack adhesive is applied to spines of the signatures prior to disposition of the spines within the cover. In some examples, the low tack adhesive is applied to only a partial length of the spines of the signatures. In some examples, the partial length of the spines is a central portion of the spines.

An example method includes applying a low tack adhesive to one or more of a cover or signatures, the cover defining an interior spine, and coupling the signatures to the interior spine via the low tack adhesive, where the coupling is to facilitate a removal of the signatures from the cover at an open end of the cover.

In some examples, the example method also includes assembling a retention tab to opposing ends of the cover to retain the signatures within the cover. In some examples, includes applying the low tack adhesive includes placing the low tack adhesive along only a portion of a length of the signatures. In some examples, the example method also includes trimming the cover and the signatures simultaneously.

An example book includes a cover defining a spine, and a first signature having a first backbone, where the first signature is disposed within the cover. The example book also includes a first removable adhesive pattern disposed between the first backbone and the spine and a second signature having a second backbone, where the second signature is disposed within the cover. The example book also includes a second removable adhesive pattern disposed between the second backbone and the spine.

In some examples, the first signature includes a first ribbon and a second ribbon and the second signature includes a third ribbon and a fourth ribbon. In some examples, the first ribbon is disposed in the second ribbon such that the second ribbon forms the first backbone, and the third ribbon is disposed within the fourth ribbon such that the fourth ribbon forms the second backbone. In some examples, the cover includes a first leg and a second leg, where the spine is formed between the first leg and the second leg, a portion of the second ribbon releasable adhered to the first leg, and a portion of the fourth ribbon releasable adhered to the second leg.

In some examples, the example book further includes a third adhesive pattern to couple the first ribbon to the second ribbon. In some examples, the first adhesive pattern has a first surface area and the third adhesive pattern has a second surface area, where the second surface area is smaller than the first surface area. In some examples, the first ribbon remains coupled to the second ribbon when removed from the cover.

From the foregoing, it will be appreciated that the above disclosed methods, apparatus and articles of manufacture enable de-collatable books that are easy to separate for distribution. Further, the examples disclosed herein enable cost-efficient manufacturing of the aforementioned example de-collatable books by allowing the elimination of trimming/cutting and/or roughening processes commonly used in book production.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A method comprising:

applying first and second removable adhesive patterns to one or more of a cover or signatures, the cover defining an interior spine, the signatures including first and second signatures;

coupling the first signature to the interior spine via the first removable adhesive pattern, the first signature having a first backbone, wherein the first signature includes a first ribbon and a second ribbon, and wherein the first ribbon is disposed in the second ribbon such that the second ribbon forms the first backbone;

coupling the second signature to the interior spine via the second removable adhesive pattern, the second signature having a second backbone, wherein the second signature includes a third ribbon and a fourth ribbon, and wherein the third ribbon is disposed within the fourth ribbon such that the fourth ribbon forms the second backbone; and coupling the first ribbon to the second ribbon via a third removable adhesive pattern, wherein the first removable adhesive pattern has a first surface area and the third removable adhesive pattern has a second surface area, the second surface area smaller than the first surface area.

2. The method as defined in claim 1, further including assembling a retention tab to opposing ends of the cover to retain the first and second signatures within the cover.

3. The method as defined in claim 1, wherein applying the first and second removable adhesive patterns includes placing the first and second removable adhesive patterns along only a portion of a length of the first and second signatures.

4. The method as defined in claim 1, further including trimming the cover and the first and second signatures simultaneously.

5. A book comprising:

a cover defining a spine;

a first signature having a first backbone, the first signature disposed within the cover, wherein the first signature includes a first ribbon and a second ribbon, and wherein the first ribbon is disposed in the second ribbon such that the second ribbon forms the first backbone;

a first removable adhesive pattern disposed between the first backbone and the spine;

a second signature having a second backbone, the second signature disposed within the cover, wherein the second signature includes a third ribbon and a fourth ribbon, and wherein the third ribbon is disposed within the fourth ribbon such that the fourth ribbon forms the second backbone;

a second removable adhesive pattern disposed between the second backbone and the spine; and a third removable adhesive pattern to couple the first ribbon to the second ribbon, wherein the first removable adhesive pattern has a first surface area and the third removable adhesive pattern has a second surface area, the second surface area smaller than the first surface area.

6. The book of claim 5, further comprising a retention tab coupled to opposing ends of the cover to retain the signatures within the cover.

7. The book of claim 5, wherein upon removal of the first signature, the first adhesive pattern decouples from the first signature and remains disposed on the spine.

8. The book of claim 5, wherein the first and second adhesive patterns are applied to the first and second backbones of the first and second signatures, respectively, prior to disposition of the first and second signatures within the cover.

9. The book of claim 5, wherein the first and second adhesive patterns are applied to only a partial length of the first and second backbones of the first and second signatures, respectively.

10. The book of claim 9, wherein the partial length is a central portion of the first and second signatures.

11. The book of claim 5, wherein the cover includes a first leg and a second leg, the spine formed between the first leg and the second leg, a portion of the second ribbon releasable adhered to the first leg, and a portion of the fourth ribbon releasable adhered to the second leg.

12. The book of claim 5, wherein the first ribbon remains coupled to the second ribbon when removed from the cover.

13. The book of claim 5, wherein the first and second removable adhesive patterns are to be applied between a first point at a first distance from a leading edge of the first and second signatures to a second point at a second distance from a trailing edge of the first and second signatures.

14. The book of claim 5, wherein the first and second removable adhesive patterns are applied to the first and second signatures, respectively, based on a ramped application profile proximate the first and second points.

15. The book of claim 5, wherein the first and second removable adhesive patterns are applied to the first and second signatures, respectively, based on at least one of a curved or parabolic application profile proximate the first and second points.

16. The book of claim 5, wherein the first and second removable adhesive patterns are centered between the trailing edge and the leading edge of the first and second signatures.

17. The book of claim 5, further including a fourth adhesive pattern, wherein the fourth adhesive pattern is disposed between a third point at a third distance from the leading edge of the first and second signatures to a fourth point at a fourth distance from the trailing edge of the first and second signatures.

18. The book of claim 5, wherein the first and second removable adhesive patterns overlap.

19. The book of claim 5, wherein the first and second removable adhesive patterns are coextensive.

* * * * *